United States Patent [19]

Ballas

[11] Patent Number: 4,768,665

[45] Date of Patent: Sep. 6, 1988

[54] REPRESSURIZER FOR CARBONATED DRINK CONTAINERS

[76] Inventor: Mitchell J. Ballas, 925 Nixon Ave., Indiana, Pa. 15701

[21] Appl. No.: 119,974

[22] Filed: Nov. 13, 1987

[51] Int. Cl.[4] ..... B65D 51/24

[52] U.S. Cl. ..... 215/228; 53/88; 215/260

[58] Field of Search ..... 215/228, 260; 53/88; 417/313

[56] References Cited

U.S. PATENT DOCUMENTS

| | | | |
|---|---|---|---|
| 3,557,986 | 1/1971 | Poole | 215/228 |
| 4,033,091 | 7/1977 | Saponara | 215/228 |
| 4,640,426 | 2/1987 | Wasley | 215/228 |

*Primary Examiner*—Donald F. Norton

*Attorney, Agent, or Firm*—William J. Ruano

[57] ABSTRACT

A hand operated pump has a threaded extension which is engaged with a threaded bottle neck. The pump is used to restore pressure in a beverage bottle.

4 Claims, 2 Drawing Sheets

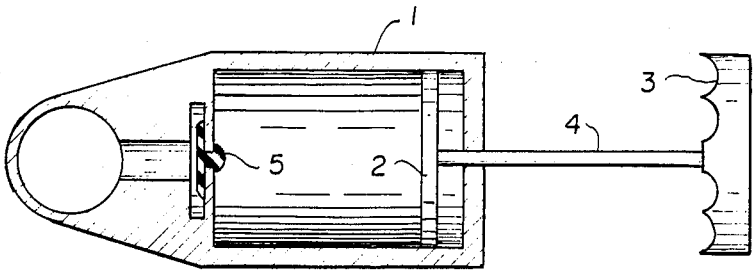
Fig.1a
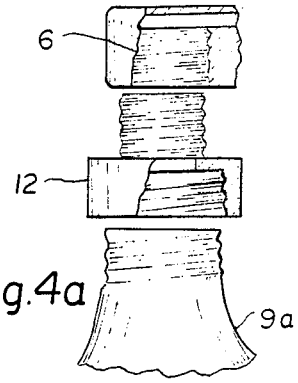
Fig.4a
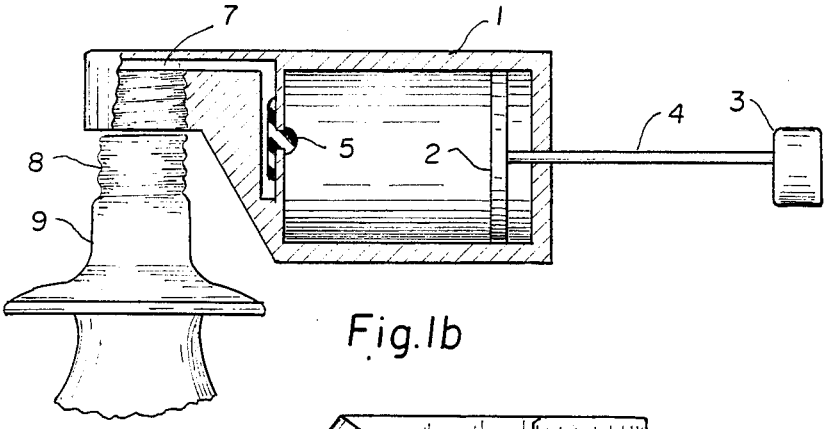
Fig.1b
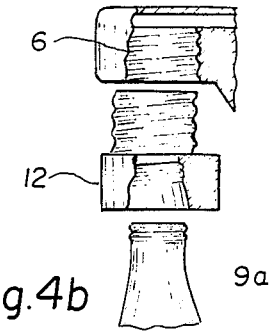
Fig.4b
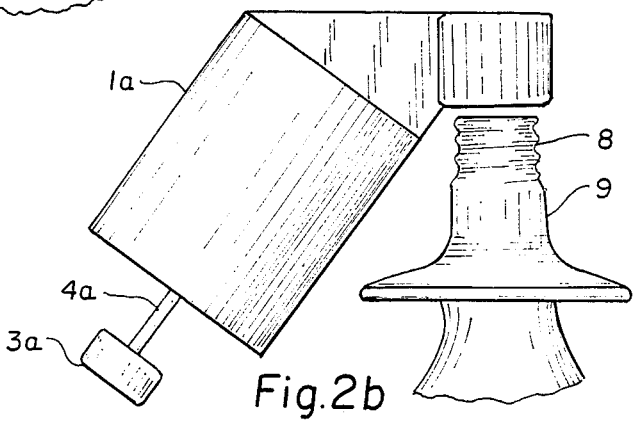
Fig.2b
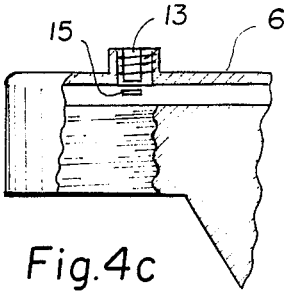
Fig.4c
Fig.2a
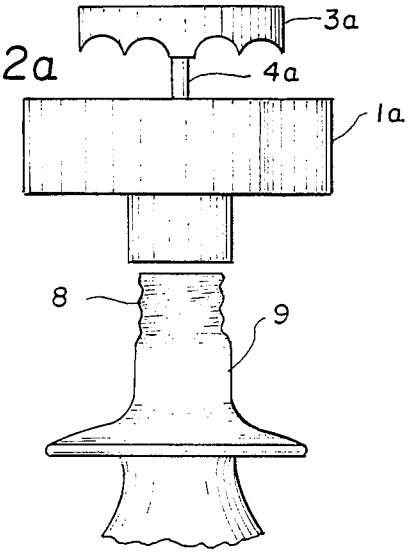
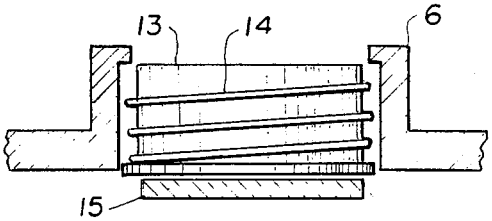
Fig.4d

REPRESSURIZER FOR CARBONATED DRINK CONTAINERS

This invention relates to the preservation of the carbonation in soft drinks.

BACKGROUND OF THE INVENTION

Before the advent of plastic containers, the amount of soft drink in a typical glass bottle was twelve fluid ounces. This amount is one or two servings, and the contents were usually completely consumed upon opening the bottle. If the contents weren't completely consumed before it went flat, the amount wasted wasn't significant for anyone to complain about.

Two and three liter bottles of soft drink have the potential problem of wasting unacceptable amounts of beverage. When the bottle leaves the bottling plant, it is pressurized at about fifteen psi as a result of the carbonation process. Upon opening the bottle, this pressure is lost, and causes the beverage to begin fizzing. With the bottle recapped, fizzing continues until the fizzing action itself repressurizes the bottle again to fifteen psi. The concentration of beverage carbonation decreases then, each time this process is repeated.

The loss of pressure above the liquid is what triggers the fizzing. Systems exist today to restore this pressure using canisters of compressed carbon dioxide. There is no system set-up for the disposable plastic bottles and $CO_2$ canisters. The $CO_2$ canister systems also have the drawback of always having to have on hand a supply of canisters. The use of pure $CO_2$ just to restore pressure is also unnecessary. All that is needed to hold the $CO_2$ in solution with the beverage is a compressed gas above the liquid. This invention then provides a method for using air to preserve carbonation.

SUMMARY OF THE INVENTION

The invention relates to a bottlecap such as one having a screw threaded top, which bottle cap embodies an air pump. The air pump may take various forms.

BRIEF DESCRIPTION OF THE DRAWINGS

FIGS. 1*a* and 1*b* are top and elevational cross-sections, respectively, of a bottle cap and air pump assembly embodying the present invention;

FIGS. 2*a* and 2*b* are elevational views of modifications of the cap assembly;

FIG. 4*a* and 4*b* are elevational views, partly in cross-section, showing an adapter.

FIG. 4*c* is a partial cross-sectional view of a pressure indicator for the cap; and FIG. 4*d* is an enlarged cross-sectional view of the indicator, per se.

DESCRIPTION OF THE PREFERRED EMBODIMENTS

Figure 3:
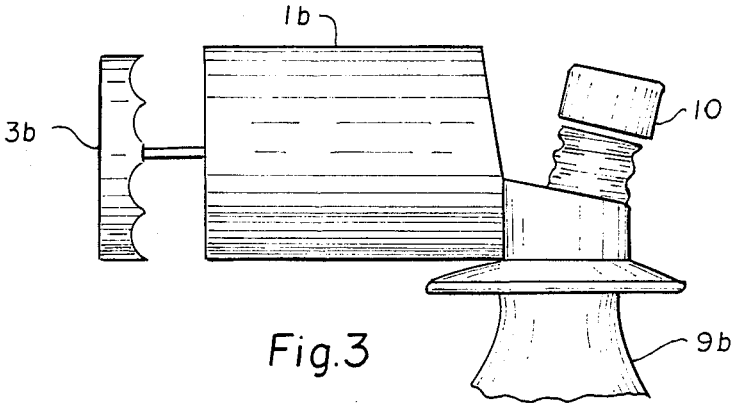
FIG. 3 is an elevational view of further modification of the cap assembly.

This invention utilizes a small hand-operated, air pump, FIGS. 1*a*,1*b*, to restore the pressure in a beverage bottle after resealing the bottle 9 which is threaded at 8. The pump screws onto the bottle using the threading 7. Note: All views of bottles show their top and neck portion only. The pump is of the type used in insecticide sprayers, or bicycle-tire pumps. On the downstroke of handle 3, the plunger 2 pushes an amount of air through or past the valve 5 into the bottle 9. On the upstroke, the pump cyclinder refills with air from the atmosphere, readying the pump for the next downstroke. The valve permits airflow in only one direction; intowards the bottle, but only up to a certain pressure difference for safety's sake. This limit pressure is set by the design of the valve dimensions and should be set as close to fifteen psi as possible. This way the bottle pressure will never exceed the necessary pressure for carbonation preservation. This should prevent possible injury due to an overpressurization of the bottle and subsequent failure of the bottle and/or pump. Rod 4 connects the hand to the plunger 2.

In FIGS. 1*a*, 1*b*, the pump is shown as acting as the cap for the bottle also. This need not be the case. A separate cap could be designed to fit elsewhere, or the pump could possibly be designed as an integrable part of the bottle (permanently attached to the bottle). See FIG. 3. Note the cap 10. Pump 16 is joined to the bottle 9*b*. In FIG. 2, some other possible designs for the pump are shown. The only difference is the geometry of the pumps. The part numbers correspond to the same parts as shown in FIGS. 1*a* and 1*b*.

Since carbonated drinks come in bottles of different dimensions, it is proposed to construct the removable pumps to fit one set of bottle specifications then, fit the bottle with adapters to enable the pump to fit onto, or mate to, other bottles of different specifications. See FIGS. 4*a*, 4*b*. The one-liter and two-liter bottles share a common top dimension and threading. If a removable pump 6 were to be designed to fit this class of tops, then an adapter 12 to mate pump 6 to larger diameter tops 9*a* in FIG. 4*a*, could be used. If the bottle has no threading, like wine bottles, an adapter 12 like that in FIG. 4*b* could mate the bottle 9*b* and pump 6 up. Also, if the threading is different, the type of adapter 12 in FIG. 4*a* would do. Adapters like these would make the pump useful on any type of container which might contain some type of carbonated beverage, alcoholic or non-alcoholic. The secret is to restore pressure in the bottle as soon as possible to retain the bubbly characteristic of the beverage.

In FIGS. 4*c* and 4*d* a device is shown which could be included in the design of a pump 6. It is a device to let the person using the pump know when sufficient pressure has been attained in the bottle. The flagging device uses a spring 14 or something similar to pop a colored button 13 up when sufficient pressure exists in the bottle. This lets the user know that it's time to stop pumping. This device also would act as a check on the pressure. A look at the nob would let one know if the internal pressure was o.k. or not. The nob would go back down if the bottles internal pressure were to fall below fifteen psi. Spring 14 presses button 13 against backstop 15 when insufficient internal pressure exists. In this condition button 13 is flush with the surrounding pump base 6. As the internal pressure nears fifteen psi. the button is pushed upward compressing the spring. The button extends above the base of the pump assembly showing the user that enough air has been pumped into the bottle.

Figure 5:
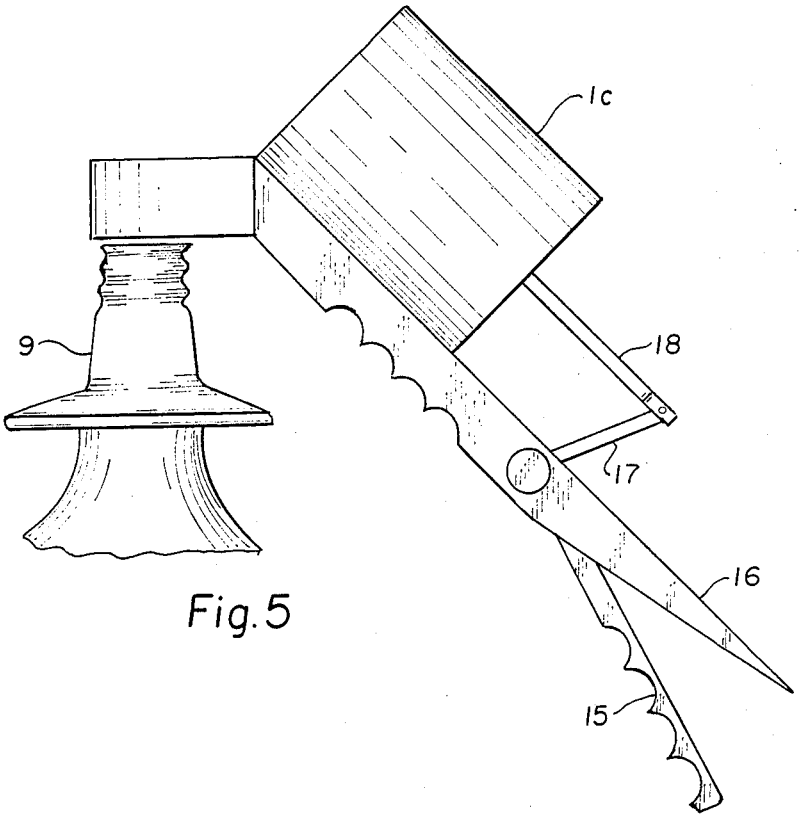
FIG. 5 is an elevational view of a still further modification.

FIG. 5 shows a further modification having a screw threaded bottle top 9 onto which mates a pump assembly with cylinder 1*c* having a piston operated by piston rod 18 and link 17 which, in turn, are actuated by a trigger-type or squeeze-type trigger 15, and handle 16.

Thus it will be seen that I have provided a novel and highly efficient bottle cap and air pump assembly which is effective to maintain pressure on the liquid of the bottle.

While I have illustrated and described several embodiments of my invention, it will be understood that these are by way of illustration only and that various changes and modifications may be contemplated in my invention and within the scope of the following claims:

I claim:

1. In combination with a bottle having an externally threaded opening, a hand operated pump including a cylinder, a piston therein, and a handle externally of said piston extending laterally away from said bottle, a one way operating valve at one end of said cylinder, said cylinder having an integral extension which is internally threaded to engage said threaded opening of the bottle, a port connecting said internally threaded extension and valve, whereby air may be compressed in said bottle without adding appreciable height to the assembly.

2. Apparatus as recited in claim 1 wherein the axis of said piston is substantially at right angles to that of said bottle.

3. Apparatus as recited in claim 1 wherein the axis of said piston is at an acute angle to that of said bottle.

4. Apparatus as recited in claim 1 together with pressure responsive indicating means for denoting when a predetermined pressure has been attained in said bottle.

* * * * *